United States Patent [19]

Wada et al.

[11] 4,151,684

[45] May 1, 1979

[54] GRINDING MACHINE WITH A RE-TRUING DEVICE

[75] Inventors: Ryuji Wada, Nagoya; Ikuo Suzuki, Chiryu; Hayashi Kodama, Kariya, all of Japan

[73] Assignee: Toyoda-Koki Kabushiki-Kaisha, Aichi, Japan

[21] Appl. No.: 841,675

[22] Filed: Oct. 13, 1977

[30] Foreign Application Priority Data

Oct. 15, 1976 [JP] Japan ..... 51/124328

[51] Int. Cl.[2] ..... B24B 5/00; B24B 53/04

[52] U.S. Cl. ..... 51/5 D; 125/11 R; 125/11 CD

[58] Field of Search ..... 125/11 R, 11 CD; 51/165.87, 165.88, 5 D

[56] References Cited

U.S. PATENT DOCUMENTS

| | | | |
|---|---|---|---|
| 2,947,302 | 8/1960 | Patterson | 125/11 CD |
| 3,037,330 | 6/1962 | Weigand | 125/11 CD |
| 3,314,410 | 4/1967 | Knauer | 125/11 CD |
| 3,424,566 | 1/1969 | Kuenstle | 125/11 CD X |
| 4,073,281 | 2/1978 | Asaeda | 125/11 CD |

*Primary Examiner*—Harold D. Whitehead
*Attorney, Agent, or Firm*—Oblon, Fisher, Spivak, McClelland & Maier

[57] ABSTRACT

A grinding machine wherein a CBN grinding wheel is rotatably carried to grind a workpiece on a work support device and is provided with a re-truing device, in addition to a truing and dressing device rotatably carrying a truing roll and a counter roll. When a truing and dressing instruction is generated, the CBN wheel is first trued with the truing roll, is then dressed by free abrasive grain supplied between itself and the counter roll and is finally re-trued with a diamond impregnated truing bar carried on the re-truing device. A re-truing infeed of the truing bar against the CBN wheel is considerably less than a truing infeed of the CBN wheel against the truing roll, and therefore the re-truing is effected on cutting edges of the wheel abrasive grain damaged by the free abrasive grain in dressing, whereby the cutting edges are made somewhat dull.

10 Claims, 10 Drawing Figures

GRINDING MACHINE WITH A RE-TRUING DEVICE

BACKGROUND OF THE INVENTION

1. Field of the Invention

The present invention relates to a grinding machine with devices for truing and dressing a grinding wheel made of hard material, such as cubic boron nitride (CBN).

2. Description of the Prior Art

For the purpose of truing and dressing such CBN grinding wheels, there has recently been developed a truing and dressing device which, after truing a CBN wheel with a truing roll, having diamond particles secured to its circumferential surface for reforming the wheel surface, dresses the trued CBN wheel by supplying free abrasive grain between the same and a counter roll so as to cut away bond material and to thereby protrude the wheel abrasive grain from the remaining bond material of the wheel surface. Using such a truing and dressing device, surface roughness of the grinding surface of the CBN wheel trued and dressed by the device relatively quickly deteriorates in proportion to the increase in the number of workpieces being ground, as indicated by the dotted line (A) of FIG. 5, and this raises one of the problems of the prior art, namely that the wheel life, or the truing and dressing interval of the CBN wheel, is short.

In order to solve such a problem, the present inventors made various experiments, from which it was found that the free abrasive grain in dressing, when cutting away the bond material of the wheel surface to cause the wheel abrasive grain to protrude somewhat, acted also on the wheel abrasive grain which had been trued, to damage or lift the same from the remaining bond material. From the experiments, it was further found that, in cases where the CBN wheel was re-trued after truing and dressing, a considerably long life could be expected, as indicated by the solid line (B) of FIG. 5.

SUMMARY OF THE INVENTION

Accordingly, it is a primary object of the present invention to provide an improved grinding machine capable of utilizing a CBN grinding wheel over an elongted wheel life thereof, as well as finishing workpieces with highly enhanced accuracy of surface roughness.

Another object of the present invention is to provide an improved grinding machine with a device for curing or correcting cutting edges of wheel abrasive grain which is damaged or lifted from the remaining bond material of a wheel surface by free abrasive grain in a previous dressing.

Another object of the present invention is to provide an improved grinding machine of the character set forth above wherein, in addition to truing and dressing, retruing is also effected on a CBN grinding wheel so as to eliminate faults created on the wheel surface in a previous dressing.

Briefly, according to the present invention, there is provided a grinding machine which comprises, in combination, a bed, a wheel head slidably mounted upon the bed and adapted to rotatably carry a grinding wheel made of cubic boron nitride, work support means for rotatably supporting a workpiece, feed means for feeding the wheel head toward and away from the work support means, truing means for truing said grinding wheel, dressing means for dressing the wheel in cooperation with free abrasive grain, re-truing means for retruing the wheel, and control means for operating the truing means, the dressing means and the re-truing means in order when receiving a truing and dressing instruction.

In operation, the truing means reforms a grinding surface of the wheel, and the dressing means removes bond material from the surface, in cooperation with the free abrasive grain, so as to thereby protrude wheel abrasive grain from the remaining bond material of the surface. Following dressing, the retruing means is operated to true cutting edges of the wheel abrasive grain, so that faults created on the cutting edges by the free abrasive grain in the previous dressing can be eliminated.

BRIEF DESCRIPTION OF THE DRAWINGS

Various other objects, features and attendant advantages of the present invention will be readily appreciated as the same becomes better understood from the following detailed description of a preferred embodiment, when considered in connection with the accompanying drawings, in which.

DETAILED DESCRIPTION OF THE PREFERRED EMBODIMENT

Figure 1:
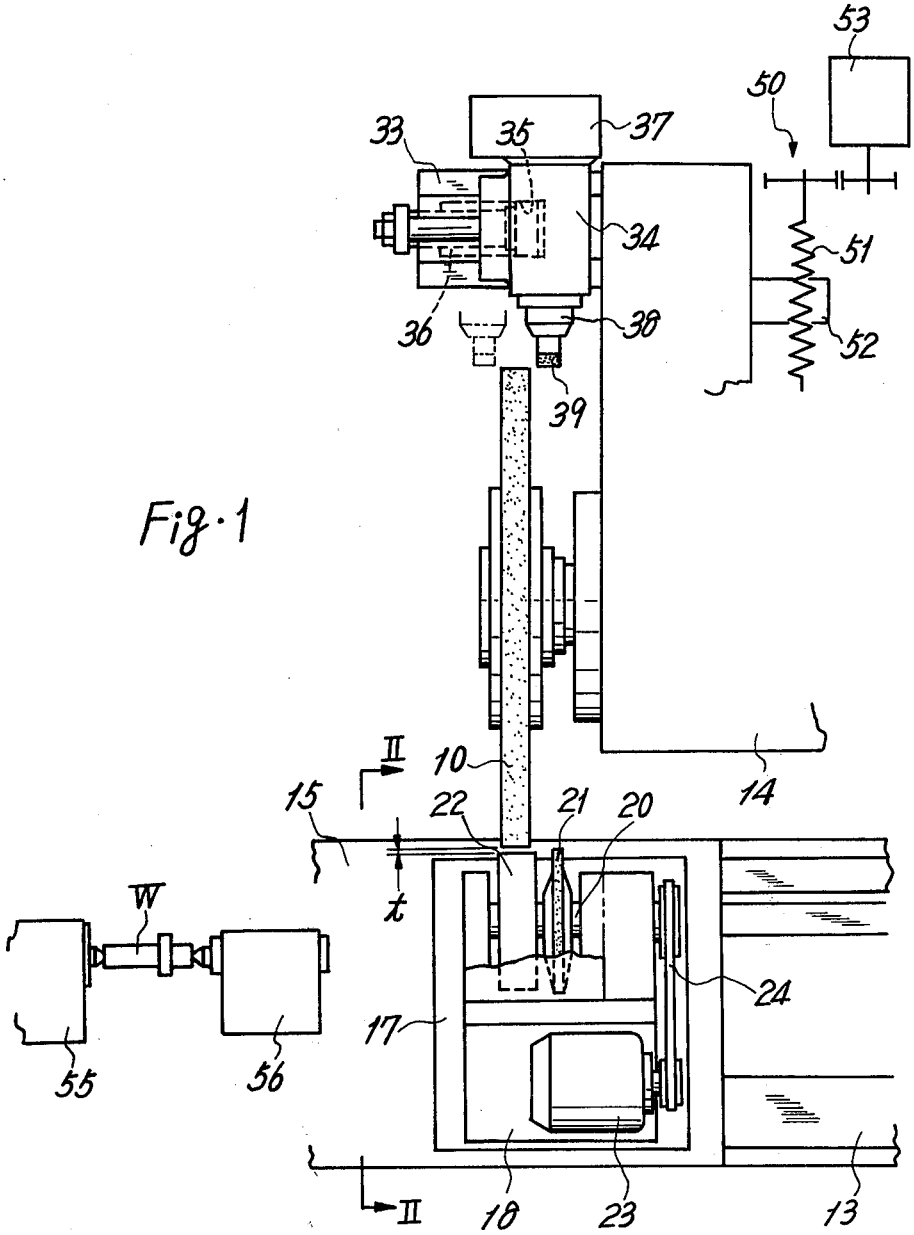
FIG. 1 is a fragmental plan view of a grinding machine according to the present invention.
Figure 2:
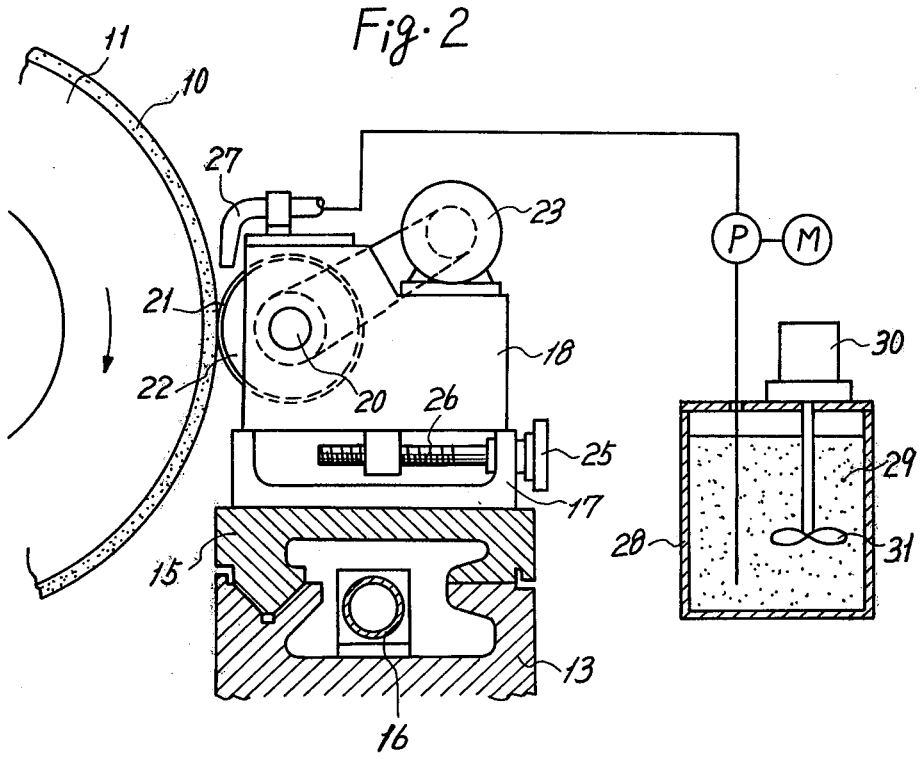
FIG. 2 is a fragmental sectional view of the apparatus, taken along the line II—II of FIG. 1.

Referring now to the drawings, wherein like reference numerals designate like or corresponding parts throughout the several views, and more particularly to FIGS. 1 and 2 thereof, a grinding wheel is indicated at 10, which is of a configuration that an abrasive grain made of hard material, such as, for example, cubic boron nitride (CBN), is bonded upon the circumferential surface of a base ring 11 with metal, resin or other bond material. The grinding wheel 10 is rotatably carried upon a wheel head 14, which is slidably mounted on a bed 13. An infeed device, generally indicated at 50, is provided to effect the slide movement of the wheel head 14 and comprises a feed screw shaft 51, a nut 52 and a servomotor 53. A wheel drive motor, not shown, is provided upon the wheel head 14 and drivingly connected to the grinding wheel 10 so as to rotate the same in a direction indicated by the arrow in FIG. 2. A table 15 is slidably mounted upon the bed 13 for movement in a direction parallel with the grinding surface of the wheel 10, namely in a direction transverse to the slide movement of the wheel head 14, and is arranged to be moved by a table feed cylinder 16. A headstock 55 and a footstock 56 are disposed upon the table 15 for support of a workpiece W to be ground with the grinding wheel 10.

Mounted on one end of the table 15 is a base 17, on which a support carriage 18 is slidably mounted for movement in a direction transverse to the slide movement of the table 15. The slide position of this carriage 18 is adjustable by manipulating a hand-wheel 25, from which a screw shaft 26 extends for a threaded engagement with the carriage 18. A support spindle 20 is rotatably carried on the carriage 18 in a parallel relation with the rotational axis of the grinding wheel 10, and a truing roll 21 for truing the grinding wheel 10 and a counter roll 22 for backing up free abrasive grain, referred to later, in dressing of the wheel 10, are keyed on the support spindle 20 with a predetermined separation. The truing roll 21 is composed of a base ring, to the circumferential surface of which diamond particles are sintered with a copper base alloy, and the width of the roll 21 is sized to be narrower than that of the grinding wheel 10 so as to reduce the resistance in truing. The counter roll 22 is made of refined steel, hardened steel or other material which has such hardness, toughness and resistance to wear as does a refined or hardened steel, and is designed to have a little greater width than the grinding wheel 10. The radius of the counter roll 22, compared with that of the truing roll 21, is small within a means size of the aforementioned free abrasive grain for dressing, so that, when the table 15 is traversed to align the counter roll 22 with the grinding wheel 10 after truing, a gap of a predetermined distance (t) is established therebetween. For example, in the case where there is employed a free abrasive grain with a mean size of 100$\mu$, preferably the difference in radius between the rolls 21 and 22 is determined to be 50$\mu$, and the gap (t) becomes 50$\mu$.

The support spindle 20 is connected via a belt driving mechanism 24 to a roll drive motor 23 mounted on the support carriage 18, and the drive motor 23 is operable to rotate the rolls 21, 22 in such a direction as to reduce the relative circumferential speed to the grinding wheel 10. A coolant nozzle 27 is provided on the support carriage 18, opposing the dressing roll 22, and is in fluid communication, via a pump P, with a reservoir 28 containing dressing coolant. The coolant is a mixture of a conventional coolant suitable for grinding and free abrasive grain 29 made of, for example, aluminum oxide, silicon carbide or other abrasive material. A mixing fan 31 drivable by a motor 30 is arranged within the reservoir 28 so as to maintain a proper mixing rate of the free abrasive grain 29 with the coolant.

Fixedly mounted upon the wheel head 14 behind the grinding wheel 10 is a support base 33, on which a slide member 34 is guided for movement in a direction parallel with the grinding surface of the wheel 10. The slide member 34 is connected to a piston rod 36, which is extensively received within a traverse cylinder 35 formed in the support base 33, so as to be reciprocated by a predetermined stroke. On the slide member 34, there is mounted an infeed ram 38, which is intermittently advanced each time an intermittent infeed device 37, as well-known, incorporating a ratchet mechanism, is actuated. A truing bar 39, which has diamond particles sintered therein with a copper base alloy, is secured to the front end of the infeed ram 38 for effecting a re-truing on the wheel 10. This re-truing aims at making somewhat dull the cutting edges of the wheel abrasive grain on the wheel surface after dressing. The feed amount of the ram 38 by the infeed device 37 is such a distance as to infeed the truing bar 39 by one or several microns ($\mu$) against the wheel 10 after dressing.

Figure 3:
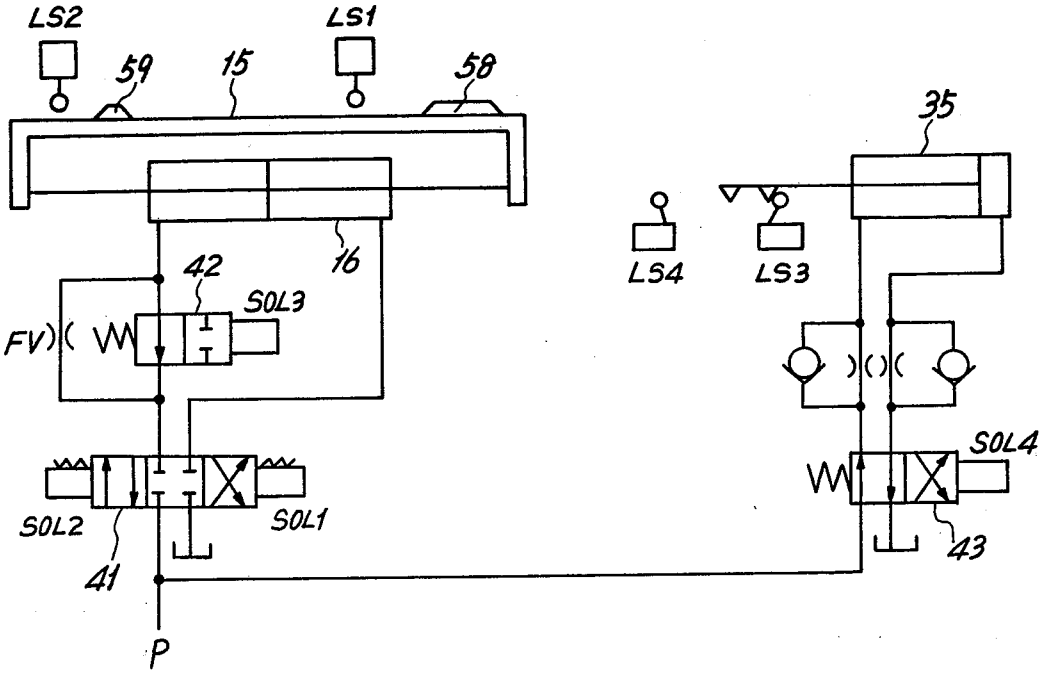
FIG. 3 is a hydraulic circuit diagram of an apparatus for controlling truing, dressing and re-truing operations.
Figure 4:
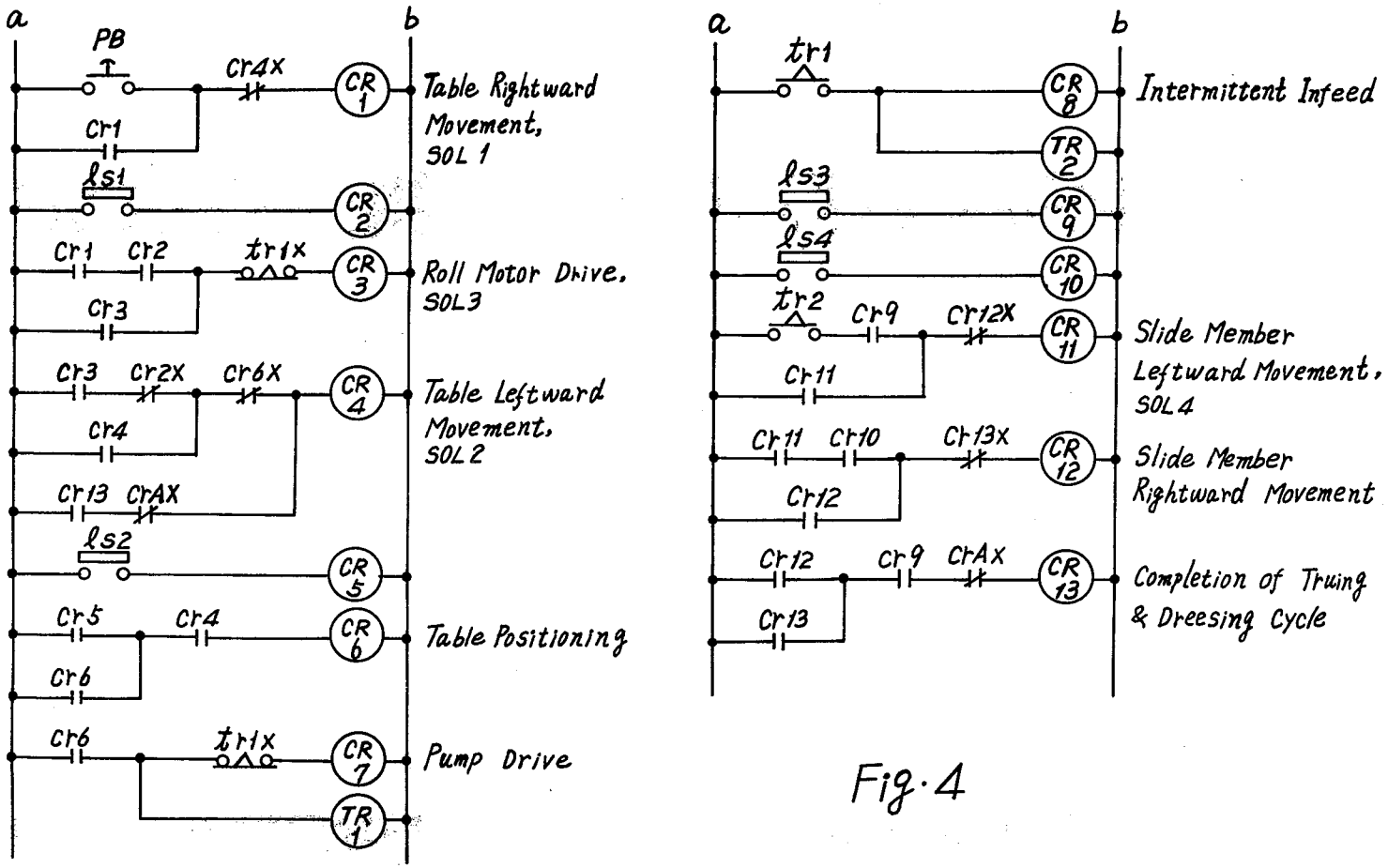
FIG. 4 is an electric circuit diagram of the apparatus for controlling the operations.

The operation of the embodiment as constructed above will hereafter be described with reference to the hydraulic and electric control circuits illustrated in FIGS. 3 and 4.

Upon completion of a previous grinding operation, the servomotor 53 of the infeed device 50 is operated so as to advance the wheel head 14, which is thereafter positioned at such a truing ready position that the grinding wheel 10 is infed by a predetermined truing amount, for example, 10$\mu$, against the truing roll 21 if they are aligned with each other. When a push button switch PB is depressed in this state, a relay CR1 is energized, to be self held through the closing of its normally open contact cr1. The relay CR1, when energized, effects the energization of a solenoid SOL1 to switch a changeover valve 41 to a right position, and fluid under pressure is supplied into the right chamber of the table feed cylinder 16, whereby the table 15 is moved toward the left, as viewed in FIG. 1.

When the table 15 is moved to such a position that is immediately before the truing roll 21 comes into contact with the grinding wheel 10, a limit switch LS1 is actuated by means of an elongated dog 58 on the table 15, and a contact Ls1 of the switch LS1 is closed to energize a relay CR2, which thus closes its contact cr2. Consequently, a relay CR3 is energized through contacts cr1 and cr2 and is self held with its contact cr3 now closed. The energization of the relay CR3 effects the energization of a solenoid SOL3, and a change-over valve 42 is switched, so that the feed rate of the table 15 is reduced to a truing feed rate, suitable for truing, which is regulated by a throttle valve FV. The energization of the relay CR3 further effects rotation of the motor 23, and the truing and counter rolls 21, 22 are thus rotated in such a direction as to reduce the relative circumferential speed thereof to the grinding wheel 10. In this condition, the grinding wheel 10 is trued with the truing roll 21.

After the table 15 is traversed at the truing feed rate by an amount sufficient enough to effect truing over the entire width of the wheel 10, the limit switch LS1 is switched from "ON" to "OFF," since it is released from the abutting engagement with the first or elongated dog 58. As a result, the relay CR2 is deenergized, which allows a relay CR4 to be energized through a contact cr3 of the relay CR3, a normally closed contact cr2*x* of the relay CR2 and a normally closed contact cr6*x*. The relay CR4, when energized, is operative to energize a solenoid SOL2, as well as to deenergize the relay CR1 through opening its normally closed contact cr4x. Because of the deenergization of the solenoid SOL1 and the energization of the solenoid SOL2, the change-over valve 41 is switched to the left position and, in consequence, fluid under pressure is supplied into the left chamber of the table feed cylinder 16. This causes the table 15 to traverse toward the right, as viewed in FIG. 1, whereby the portions of the grinding wheel 10 which were left from being trued during the last leftward movement of the roll 21, are trued with the roll 21 in this stage.

In this manner, the truing of the wheel 10 is performed through one reciprocation of traversing movement of the table 15. When the table 15, in its rightward traverse movement, is moved to such a position as to align the counter roll 22 with the wheel 10, as shown in FIG. 1, a second dog 59, secured to the table 15, actuates a limit switch LS2, whose contact ls2 is therefore closed to energize a relay CR5. Consequently, a relay CR6 is energized through a contact cr5 of the relay CR5 and a contact cr4 of the relay CR4, which is then deenergized because of the opening of a normally closed contact cr6x of the relay CR6. This results in deenergizing the solenoid SOL2 to switch the change-over valve 41 to the neutral position, whereby the table 15 is positioned at a position opposing the counter roll 22 to the wheel 10. In this stage, a gap of predetermined distance (t) is established between the counter roll 22 and the wheel 10.

The energization of the relay CR6 further results in closing a contact cr6 for energization of a relay CR7, by which the pump P is operated to supply dressing coolant from the nozzle 27 toward the gap (t). Being backed up with the counter roll 22, the free abrasive grains in the dressing coolant supplied to the gap (t) bite and cut away the bond material of the wheel 10, whereby the same is dressed to protrude the wheel abrasive grains beyond the remaining bond material. Such dressing is continued until a time relay TR1 which has been energized together with the relay CR7 is timed up. When normally closed contacts tr1x are opened with this time-up operation of the relay TR1, the relays CR7 and CR3 are deenergized to thereby discontinue operation of the pump P and the roll drive motor 23.

With the time-up operation of the relay TR1, a contact tr1 is closed for energization of a relay CR8. The energization of the relay CR8 effects an operation of the intermittent infeed device 37 to infeed the truing bar 39 against the grinding wheel 10. Specifically, since in the previous truing, the wheel 10 was infed by 10$\mu$ against the truing roll 21, the infeed ram 38 is advanced by, for example, 12$\mu$, so that the truing bar 39 is infed by one or serveral microns against the wheel 10.

When a time relay TR2, which has been energized together with a relay CR8, is timedup, a contact tr2 is closed and a relay CR11 is energized through the contact tr2 and a contact cr9, since a relay CR9 has been energized through a contact ls3 of a limit switch LS3, which is provided for confirming the retracted end of the slide member 34. A solenoid SOL4 is thus energized to switch a change-over valve 43 to the right position, and fluid under pressure is supplied into the right chamber of the traverse cylinder 35. The slide member 34 is traversed toward the left, as viewed in FIG. 1, and the wheel 10 is re-trued with the truing bar 39. In this re-truing, since the infeed amount of the truing bar 39 against the wheel 10 is extremely small, truing is effected on cutting edges of the wheel abrasive grain which have been damaged by the free abrasive grain in the previous dressing. Namely, the re-truing serves to decelerate initial wear of the cutting edges in grinding and also to make the cutting edges somewhat dull. It is therefore to be understood that not only is the life of wheel 10 extended, but surface roughness of workpieces ground by the re-trued wheel 10 is also improved.

When the slide member 34 is moved to its left traverse end, a limit switch LS4 for confirmation of such a traverse end is actuated, whose contact ls4 is thus closed to energize a relay CR10, and a relay CR12 is in turn energized through a contact cr10 of the relay CR10. Since the relay CR12, when energized, causes the deenergization of the relay CR11 by opening its normally closed contact cr12x, the solenoid SOL4 is deenergized to allow the change-over valve 43 to be restored to its original position. Accordingly, fluid under pressure is supplied into the left chamber of the traverse cylinder 35 to move the slide member 34 to the original position thereof, so that the re-truing is completed. The limit switch LS3 is actuated when the slide member 34 reaches the original position. A contact ls3 of the switch LS3, when closed, results in energizing a relay CR13, and the relay CR4 is again energized because of the closing of a contact cr13. With the energization of the relay CR4, the table 15 is moved toward the right in a similar manner to that described above, so as to be ready for the next grinding cycle, and when the table 15 reaches its grinding ready position, normally closed contacts crAx are opened, whereby the relays CR4, CR13 are deenergized.

Although the truing bar 39, for re-truing the wheel 10 after the truing and dressing, is provided behind the wheel 10 in the foregoing embodiment, it is to be noted that the truing bar 39 can otherwise be provided on the table 15 in a side-by-side relation with the truing and dressing rolls 21, 22. It is further to be noted that the truing bar 39 can be replaced by another truing roll of the same type as the truing roll 21.

Figure 5:
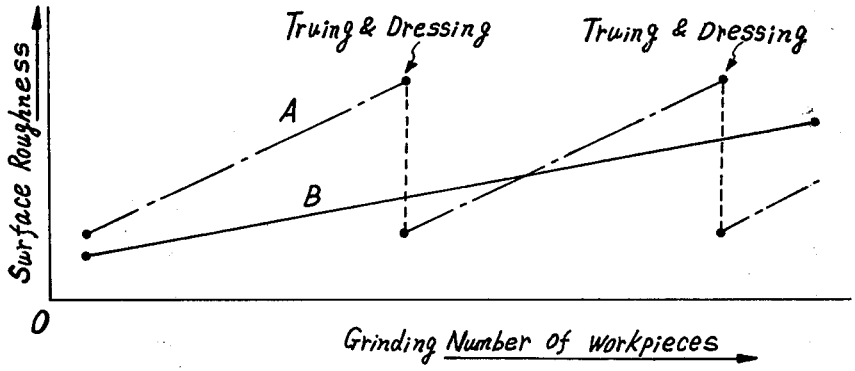
FIG. 5 is a graphical representation illustrative of a relationship between surface roughness of a grinding wheel surface and the number of ground workpieces.

As described in detail, the present invention provides a grinding machine with a truing and dressing device, in which the CBN grinding wheel is first trued with the truing roll, is then dressed by the free abrasive grain backed up with the counter roll and is further re-trued with a re-truing tool. Accordingly, the cutting edges of the wheel abrasive grain damaged by the free abrasive grain in the previous dressing are trued to be made somewhat dull, so that surface roughness of the wheel surface can be improved, as noted by the solid line (B) of FIG. 5. Furthermore, since the re-truing effects to decrease initial wear of the wheel surface in subsequent grinding operation, the life, namely the truing and dressing interval, can also be extended.

Figure 6A:
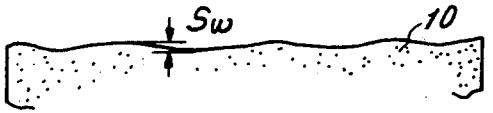
FIGS. 6A to 6E are explanatory views showing the surface configurations of a CBN grinding wheel observed, respectively, after grinding, truing, dressing and re-truing.
Figure 6B:
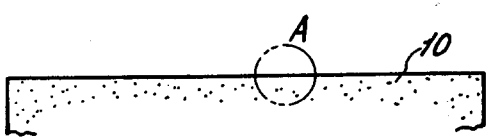
Figure 6C:
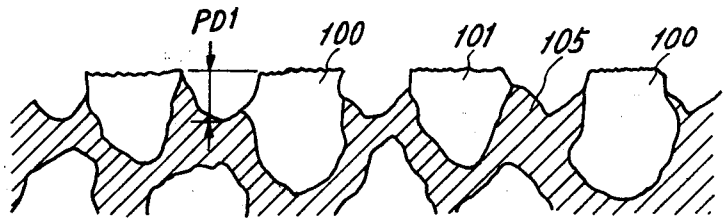
Figure 6D:
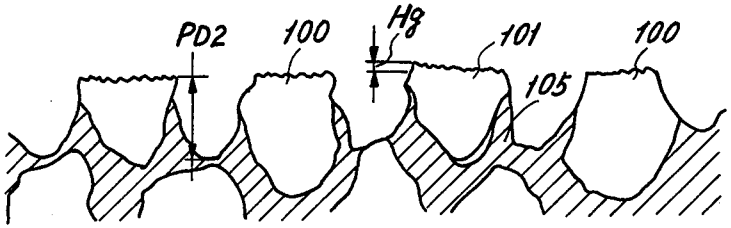
Figure 6E:
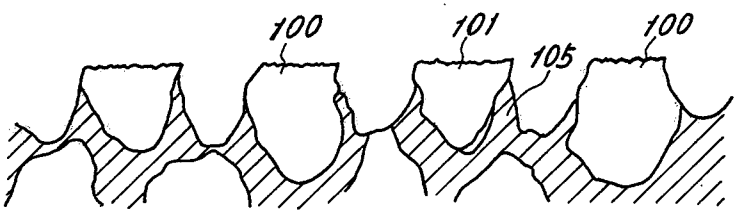

In FIGS. 6A to 6E, there are illustrated surface configurations of the grinding wheel 10 observed, respectively, after grinding, truing, dressing and re-truing. The execution of a grinding operation provides a swell Sw on the wheel surface, as viewed in FIG. 6A. When the wheel 10 is trued with the truing wheel 21, the swell Sw is eliminated and a new straight profile, whose portion A is shown in FIG. 6C, appears on the wheel surface, as viewed in FIG. 6B. It is, of course, to be understood that the truing infeed of the wheel 10 against the truing roll 21 must be larger than the height of the swell Sw. With the subsequent dressing, pores on the wheel surface are deepened from a depth PD1 to another depth PD2, as viewed in FIG. 6D. With the dressing, the cutting edgs of the weel abrasive grain 100 are excessively sharpened and damaged by the free abrasive grain supplied between the wheel 10 and the counter roll 22, and some of the wheel abrasive grain, as indicated at a reference numeral 101, is lifted by a height Hg from the remaining bond material 105. When the re-truing is performed, the cutting edges of the wheel abrasive grain 100, 101 are trued to be made somewhat dull and the cutting edge of the grain 101 so lifted is placed at the same level as the cutting edges of other grains 100, 100 on the wheel surface, as viewed in FIG. 6E. It is therefore realized that one or serveral microns ($\mu$) are enough for the re-truing infeed of the truing bar 39 against the wheel 10.

Obviously many modifications and variations of the present invention are possible in light of the above teachings. It is to be understood therefore that within the scope of the appended claims this invention may be practiced otherwise than as specifically described herein.

What is claimed as new and desired to be secured by Letters Patent of the United States is:

1. A grinding machine comprising in combination;
a bed;
a wheel head slidably mounted upon said bed and adapted to rotatably carry a grinding wheel made of cubic boron nitride;
work support means for rotatably supporting a workpiece;
feed means for feeding said wheel head toward and away from said work support means;
truing means including a truing roll for truing said grinding wheel through contact therebetween so as to reform a grinding surface of said grinding wheel to a predetermined profile, said truing roll being provided at a circumferential surface thereof with abrasive grain as hard as diamond and being rotatable about an axis parallel with the rotational axis of said grinding wheel;
dressing means including a counter roll and means for supplying free abrasive grain and adapted to establish a gap of a predetermined distance between said counter roll and said grinding wheel for removing bond material from said grinding surface in cooperation with said free abrasive grain supplied into said gap so as to thereby protrude wheel abrasive grain on said grinding surface from remaining bond material, said counter roll being made of metal and being rotatable about an axis parallel with the rotational axis of said grinding wheel;
re-truing means including a re-truing tool for re-truing said grinding wheel through contact therebetween so as to true cutting edges of said wheel abrasive grain damaged by said free abrasive grain in dressing; and
control means for successively operating first said truing means, then said dressing means and finally, said re-truing means upon actuation.

2. A grinding machine as claimed in claim 1, further comprising:
a table slidably mounted o said bed for movement in a direction transverse to the slide movement of said wheel head and mounting thereon said work support means, said truing means and said dressing means, and
table feed means for moving said table in that direction so as to selectively align said work support means, said truing means and said dressing means with said grinding wheel.

3. A grinding machine as claimed in claim 2, wherein said re-truing means is mounted on said wheel head.

4. A grinding machine as claimed in claim 3, wherein:
said means for supplying said free abrasive grain is adapted to continue supplying said free abrasive grain into said gap between said counter roll and said grinding wheel during a dressing operation;
the mean size of said free abrasive grain is larger than said gap; and
said truing and dressing means are incorporated with each other and further include:
a support carriage mounted on said table and carrying said truing and counter rolls in position to establish said gap between said counter roll and said grinding wheel when said wheel head is fed to such a position as to contact said truing roll with said grinding wheel, and
drive means for rotating said truing and counter rolls.

5. A grinding machine as claimed in claim 4, wherein said truing and counter rolls carried on said support carriage are rotatable about a common rotational axis parallel with the rotational axis of said grinding wheel, and wherein the radius of said counter roll is sized to be smaller than that of said truing roll, whereby said gap of said predetermined distance is established between said counter roll and said grinding wheel every time said truing operation is performed.

6. A grinding machine as claimed in claim 5, wherein said drive means is arranged to rotate said truing and counter rolls in such a direction as to reduce the relative circumferential speed of the same to said grinding wheel.

7. A grinding machine as claimed in claim 6, wherein said re-truing means comprises;
a support base fixedly mounted on said wheel head;
a slide member slidably mounted on said support base for movement in a direction parallel with the grinding surface of said grinding wheel;
feed means for feeding said slide member in that direction;
an infeed ram slidably mounted on said slide member for infeed movement transverse to the slide movement of said slide member;
a re-truing tool mounted on said infeed ram for re-truing said grinding wheel; and
intermittent infeed means for intermittently infeeding said infeed ram so as to give said re-truing tool a predetermined re-truing infeed against said grinding wheel.

8. A grinding machine as claimed in claim 7, wherein said predetermined re-truing infeed of said re-truing tool against said grinding wheel is less than half of the predetermined truing infeed by which said grinding wheel is infed against said truing roll whenever a truing operation is performed.

9. A grinding machine as claimed in claim 7, wherein said re-truing tool is a diamond-impregnated truing bar.

10. A grinding machine as claimed in claim 9, wherein said means for supplying said free abrasive grain is adapted to supply toward said gap a mixture of said free abrasive grain and a coolant fluid.

* * * * *